United States Patent [19]

Ghizzi

[11] Patent Number: 4,592,784

[45] Date of Patent: Jun. 3, 1986

[54] WATER SEAL FOR FUMELESS STRAND PICKLING SYSTEM

[75] Inventor: Mario Ghizzi, Orange, Calif.

[73] Assignee: Davis Walker Corporation, Los Angeles, Calif.

[21] Appl. No.: 627,554

[22] Filed: Jul. 2, 1984

[51] Int. Cl.[4] ..... B08B 1/02

[52] U.S. Cl. ..... 134/15; 55/355; 134/26; 134/28; 134/64 R; 134/72; 134/114; 266/146

[58] Field of Search ..... 134/10, 15, 25.4, 26, 134/28, 60, 61, 64 R, 68, 72, 114, 122 R; 55/240, 241, 355; 98/36, 115 SB; 266/146, 147

[56] References Cited

U.S. PATENT DOCUMENTS

| | | | |
|---|---|---|---|
| 482,489 | 9/1892 | Somers et al. | 134/114 X |
| 1,687,617 | 10/1928 | Jewell | 134/114 |
| 3,473,791 | 10/1969 | White et al. | 134/105 X |
| 3,595,254 | 7/1971 | White et al. | 134/114 X |
| 3,687,145 | 8/1972 | Schrader et al. | 134/114 |
| 3,868,272 | 2/1975 | Tardoskegyi | 134/72 X |
| 4,076,222 | 2/1978 | Schaming | 134/64 R X |
| 4,184,500 | 1/1980 | Herbst | 134/114 |
| 4,231,806 | 11/1980 | Henry | 134/72 X |
| 4,270,317 | 6/1981 | Kurie | 134/64 R X |

*Primary Examiner*—Peter Hruskoci

*Attorney, Agent, or Firm*—Christie, Parker & Hale

[57] ABSTRACT

A device and method are set forth for continuous, fumeless treating of products like steel wire. The device includes a generally closed tank having an inlet opening to pass the wire through a passageway to exit the tank at an outlet opening. Intermediate the inlet and outlet openings along the passageway are means for treating the wire in the desired manner. To prevent fumes from the treating means from escaping through the inlet and outlet openings, the tank is provided with means for continuously cascading a liquid across the openings to define barriers against the escape of such fumes while still permitting the product to be drawn through the tank. Preferably the tank has a removable top. Extending along the sides of the top are downwardly depending side skirts which are received by and are partially submerged in the liquid filled troughs to seal against the escape of fumes.

5 Claims, 9 Drawing Figures

WATER SEAL FOR FUMELESS STRAND PICKLING SYSTEM

FIELD OF THE INVENTION

This invention relates to devices and methods for continuous treatment of products wherein objectionable fumes or vapors are present. More particularly, it relates to a device and method for fumeless strand pickling of metal wire.

BACKGROUND OF THE INVENTION

In many processes it is desired that a particular product be introduced to a chemical bath or spray. Such chemical process may include painting or cleaning or the process may consist of pickling metal products. For example, in the production of galvanized wire it is advantageous to clean and pickle the bare steel wire with hydrochloric acid before finally galvanizing the wire in a zinc bath.

There are several problems associated with cleaning and pickling (hereinafter refered to simply as pickling). One problem common to pickling processes is the generation of harmful, corrosive fumes. In pickling of metal such as wire, the wire is typically dipped through a bath of hydrochloric acid. Fumes from the bath are a health hazard and tend to corrode nearby equipment when the fumes condense thereon. One solution to this problem is to provide a high capacity ventilation system which proposes to draw the fumes into a hood and dispose of them by suitable means. Such ventilation systems are not entirely satisfactory in that a portion of the fumes still tend to escape and such ventilation systems are expensive. Where federal, state or local ordinance dictate certain clean air standards, such systems can become even more expensive.

Another solution to the problem of fumes is to provide a closed top for the tank. For batch pickling, the fumes still tend to escape when the tank is opened to remove the batch. For continuous pickling of, for example, long strands of wire, the fumes tend to escape from the open ends of the tank through which the wire is continuously passed. Furthermore, the tank must be opened to load the wire strands into the tank, again permitting the hazardous, corrosive fumes to escape.

As can be appreciated, there is a need for a device and method by which a product can be treated, either on a continuous throughput or on a batch basis, which prevents the escape of fumes and does not require expensive ventilation and exhaust systems.

SUMMARY OF THE INVENTION

There is, therefore, provided in the practice of the present invention, a device and method for continuous, fumeless treating of products such as, for example, the continuous pickling of strand products like steel wire. The device includes a generally closed tank having an inlet opening to pass, on a continuous basis if desired, a product or products, the products moving through a passageway and exiting the tank at an outlet opening. Intermediate the inlet and outlet openings along the passageway are means for treating the product in the desired manner. For example, for wire, the treating means may include a pickling wash of hydrochloric acid.

To prevent fumes from the treating means from escaping through the inlet and outlet openings, the tank is provided with means for continuously cascading a liquid across the openings, such cascading liquid defining barriers against the escape of such fumes while still permitting the product to be drawn through the tank. For the hydrochloric acid pickling of steel wire, the cascading means are preferably embodied as water cascades across the openings. A plurality of such liquid cascade means may be provided at each opening to define a series of such liquid barriers.

The method for the fumeless treating of products includes passing the products through the inlet opening of the generally closed tank, along the passageway through the tank, and out of the tank through an outlet opening. Within the tank intermediate of the openings the product is treated in the desired manner. For example, for pickling metal products, the method may include applying hydrochloric acid to the metal's surface. To prevent the escape of fumes, the method includes cascading a suitable liquid across the openings, the liquid cascades defining barriers against the escape of such fumes.

Specifically, as applied to the pickling of strand products such as metal wire for the ultimate galvanization thereof, the device and method according to the present invention includes a tank to pass one or more strands of the wire pulled therethrough on a continuous basis. The tank has an inlet opening to continuously admit the wire strands into the tank for pickling and an outlet opening for the continuous removal of the strands from the tank. Intermediate the openings the wire is bathed with a pickling solution typically embodied as hydrochloric acid. To prevent the escape of fumes resulting from the pickling of the wire, the method includes cascading a liquid, such as water, across the inlet and outlet openings. Preferably, the method includes cascading liquid at several locations across the inlet and outlet openings to define a series of barriers against the escape of fumes. The water cascading across such openings may be withdrawn from sumps defined within the tank and recirculated by pumps to define such cascades. Preferably, the steps of cascading liquid consist of continually supplying the liquid to a series of weir-like sluices disposed along the top of the tank, the sluices distributing and slowing the flow of water so as to define the continuous, barrier-forming cascades.

While the tank may be one piece, enclosed except for the openings, preferably the tank has a removable top to facilitate cleaning, inspection of the tank or the like. Extending along the sides of the top are downwardly depending side skirts. To receive the skirts and define a seal between the top of the tank and along the mutual sides thereof, liquid-filled troughs are provided. The skirts are received by and are partially submerged in the liquid-filled troughs. The liquid, such as water, is advantageously circulated through the troughs and is preferably supplied by one or more of the liquid cascades. Accordingly, by virtue of the submergence of the side skirts into the liquid at the troughs, a seal against the escape of fumes is provided.

Over and above providing a seal along the sides of the tank, the relationship between the side skirts and the troughs provides a means to load wire into the tank without lifting the top. To load one or more strands into the tank for pickling, each strand is passed through the troughs, beneath the skirts and into the tank. Accordingly, the loading of the wire does not require the lifting of the top which could result in the escape of fumes.

As can be appreciated, an advantage of the device and method for continuously treating a product, in particular the continuous, fumeless strand pickling of wire, is that the device and methods are simple to construct and operate and are also inexpensive. Furthermore, the device is particularly efficient at preventing the escape of fumes. The liquid cascades and the liquid present in the troughs keep the tank cool, resulting in the condensation of fumes within the tank. Furthermore, the device is easy to use, particularly since for strand pickling of wire, the wire may be easily loaded into the tank without removal of the top.

BRIEF DESCRIPTION OF THE DRAWINGS

These and other features and advantages of the present invention will become apparent as the same becomes better understood with reference to the specification and drawings, wherein.

DETAILED DESCRIPTION

Figure 1:
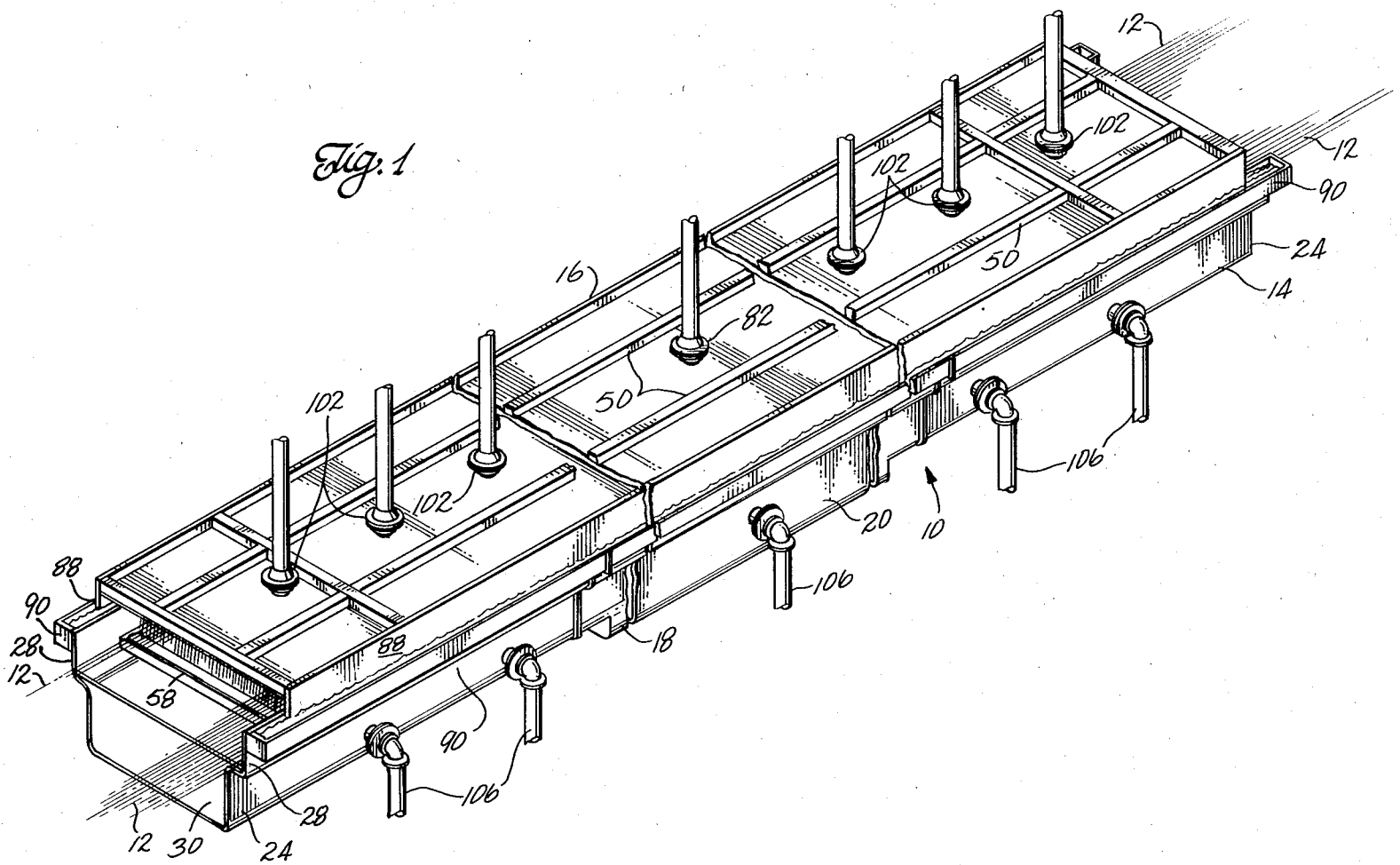
FIG. 1 is a perspective top-side view of a device for the fumeless strand pickling of wire.
Figure 2:
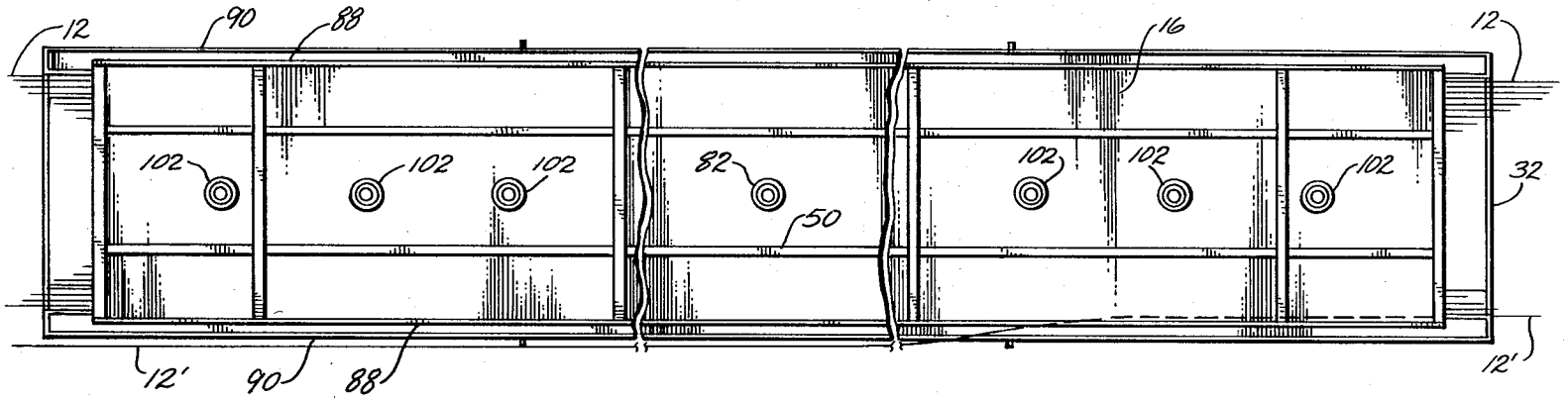
FIG. 2 is a top view of the device of FIG. 1.
Figure 3:
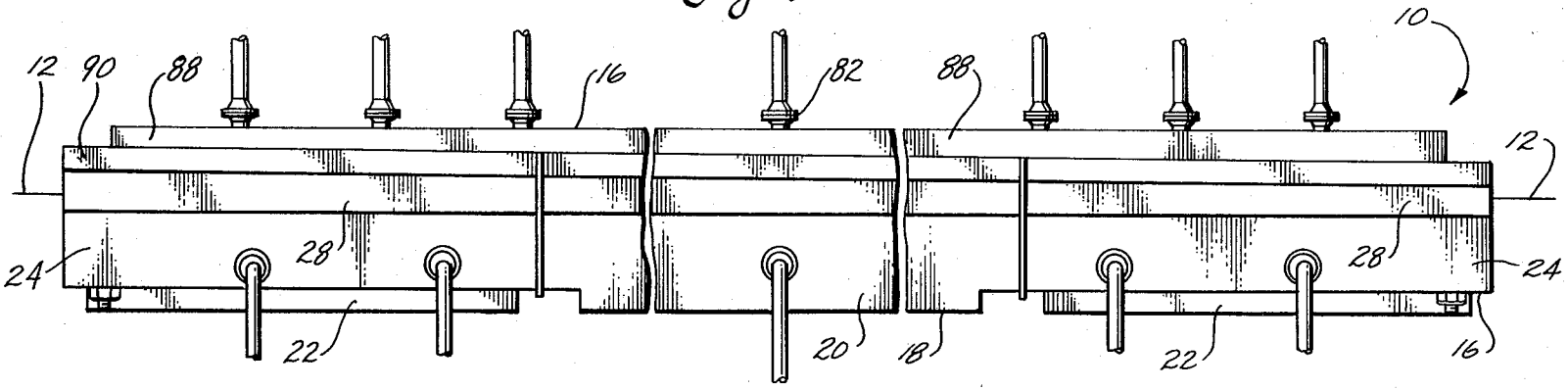
FIG. 3 is a side view of the device of FIG. 1.

Turning to the drawings, a continuous, fumeless strand pickling device 10 for pickling a product such as wire 12 is illustrated. While the description hereinafter set forth is directed toward the fumeless strand pickling of wire useful in the manufacture of galvanized wire, it is to be understood that the device and method according to the present invention are equaly applicable in any suitable process where noxious, corrosive or otherwise objectionable fumes or vapors are present or when other potentially harmful conditions exist.

In the manufacture of galvanized wire it is necessary to clean and otherwise prepare, i.e., pickle, the surface of the steel wire 12 prior to applying a zinc coating. Pickling is typically accomplished by washing the surface of the wire with an agent such as a hydrochloric acid solution. The presence of hydrochloric acid tends to result in fumes which are noxious and corrosive. The device 10 is adapted to provide for the pickling of the wire 12 while at the same time containing the aforesaid fumes.

Viewing FIGS. 1 through 5, to provide for fumeless pickling, the device 10 is seen as including a tank 14 adapted to contain one or more liquids, the tank 14 having a removable top 16. While the top 16 may be fixed and sealed to the tank 14 along its length, preferably the top 16 is removable to facilitate cleaning and inspection or otherwise provide access to the tank 14. The tank 14, which may be 50 feet or more in length, is constructed from acid corrosion-resistant materials such as fiberglass, stainless steel or the like. Defining its lower boundary, the tank 14 has a substantially flat bottom 18 which projects downwardly medially along the tank 14 to produce a well 20. The bottom 18 at the well 20 is adapted to rest on a suitable supporting foundation, the remainder of the flat bottom 18 being supported upon skids 22. It is to be understood, however, that the tank bottom could be made entirely flat.

Defining the side boundaries of the tank 14 are spaced sides 24. Each of the sides 24 projects upwardly from the bottom 18 to a horizontal, outwardly and longitudinally extending ledge 26. From the ledge 26, each side 24 continue to project upwardly to define spaced and substantially parallel side panels 28 for the tank 14.

Figure 5:
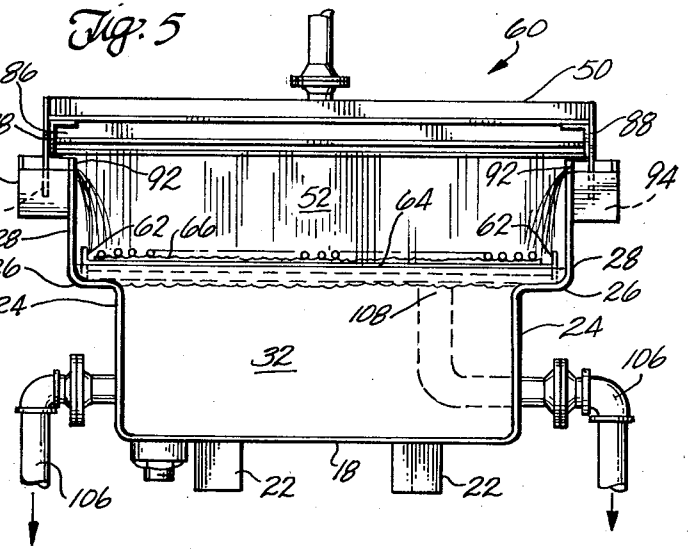
FIG. 5 is an end view of the device of FIG. 1.

To somewhat close the tank 14 at its ends, end walls 30 and 32 are provided at, respectively, a wire inlet end 34 and a wire outlet end 36. For pickling, the wire 12 is passed through the device 10 entering at the inlet end 34 and exiting the device 10 at its outlet end 36. Each of the aforesaid end walls 30 and 32 extends upwardly from the bottom 18 between the sides 24 to terminate just above the ledges 26 as best shown in FIG. 5.

The bottom 18, sides 24 and end walls 30 and 32 define a sump 38 (FIG. 4) for the tank 14 which extends over the length of the tank 14 and which is adapted to retain liquid. For purposes which will be described below, two transverse partitions 40 and 42 are disposed in the sump 38 to either side of the well 20. Each of the partitions 40 and 42 is connected and sealed to the bottom 18 and sides 24 and has an upper extent coplanar with the upper extent of the end walls 30 and 32. The partitions 40 and 42 divide the sump 38 and, in effect the entire device into, viewing FIG. 4 from left to right, a quench portion 44, a pickling portion 46 and a rinse portion 48. By virtue of the partitions 40 and 42, the sump at each of the aforesaid portions is segregated from that in the other portions so that liquid which may be contained in one sump portion cannot intermix with liquid in an adjoining portion.

To define an upper confinement to prevent escape of the fumes from the device, the top 16 is provided. The top 16 is closed and flat and extends substantially over the entire length of the tank 14. As shown in the drawings, the top 16 at each end stops short of projecting over the end walls 30 and 32. The top 16 is constructed from acid corrosion resistent materials like those of the tank 14, such as fiberglass, stainless steel or the like. Support beams 50 may be provided over the top 16 to enhance the structural strength of the top 16. To remove the top 16 from the tank 14 suitable lifting means such as cranes, winches or the like (not shown) are provided. Again, while the top 16 is preferrably removable, it is to be understood that it may be affixed along its length to the tank 14 and provided with access ways for cleaning and inspection of the tank interior.

Beneath the top 16, above the end walls 30, 32 and partitions 40 and 42 of the tank 14 and between the side panels 28, a passageway 52 is defined (FIG. 4) having an inlet opening 54 and an outlet opening 56 at, respectively, the inlet and outlet ends 34 and 36. The wire 12 is drawn continuously to the inlet opening 54, through the passageway 52 for pickling thereof, the wire exiting at the outlet opening 56. It can be appreciated that products other than wire could also be passed through the device 10 for pickling or other treatment by providing means for transporting the product through the passageway 52. Such transporting means may be a cable-type conveyor, monorail, or the like. As will also become appreciated, the device 10 can accommodate batch processing, each batch maneuvered through the inlet opening 54, passageway 52 and outlet opening 56 by any suitable means.

Figure 4:
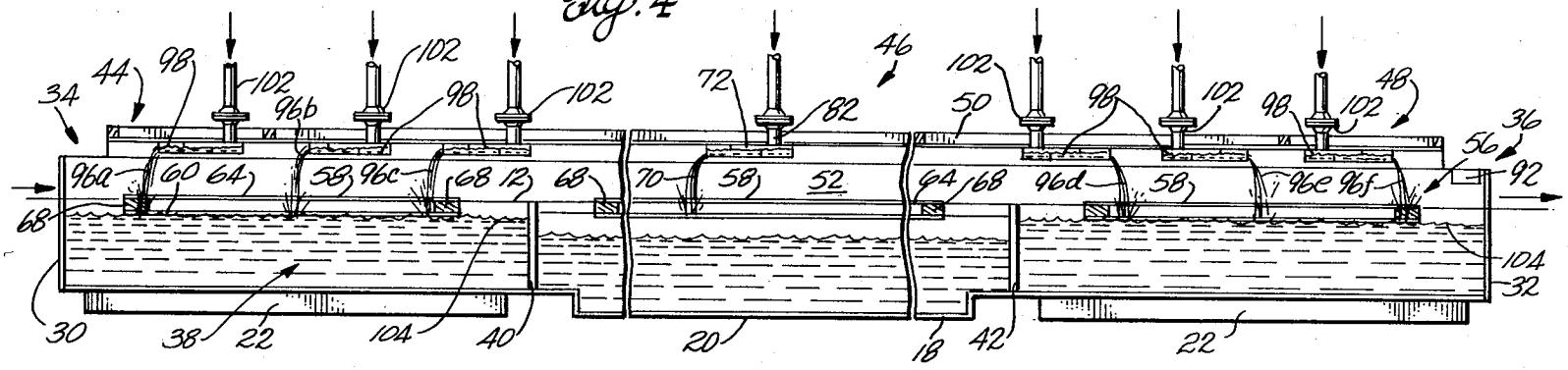
FIG. 4 is a side section view of the device according to FIG. 1 showing the means for cascading liquid to define fume barriers.

To support and guide the wire 12 as it advances through the device 10, each of the quench, pickling and rinse portions 44, 46 and 48 includes a tray 58 adapted for this purpose. Each tray 58, as best shown in FIG. 4, includes a planar, lower support member 60 adapted to rest between the ledges 26 spanning the tank sides 24. By suitable means such as spot welding, bolting or the like, the lower support member 60 may be affixed to the tank 14. Projecting upwardly from the sides of the lower support member 60 are support flanges 62 (FIG. 5) which in turn support a guide member 64 located above the lower member 60 and also spanning the tank between its sides 24. The guide and lower members 64 and 60 are virtually identical, each having a plurality of apertures (not shown) which may be embodied as holes or slits to permit liquid to pass freely through each tray 58. To provide means for guiding the strands of wire 12 as they are drawn through the device 10 in such a manner as to prevent tangling thereof, each guide member 64 is provided with a plurality of longitudinally extending tracks 66, each of which is adapted to cradle one or more strands of wire 12. The wire 12, as loaded into the device 10 for continuous pickling thereof, has one or more strands positioned in a dedicated track 66 of each such tray 58, the wire 12 being directed through the device 10 in such a manner as to maintain the strands of wire 12 in their dedicated track 64.

To provide a bearing surface for the wire 12, to resist wear upon the tray 64 by the moving wire 12, and to prevent fumes from passing between the lower support member 60 and the guide member 64 as described below, each tray 64 is provided at each end with closed, continuous wear-resistant curbs 68 made from, for example, hardened steel or the like. The strands of wire 12 are guided by the tracks 66, whereas the curbs 68 bear the weight and friction of the sliding wire 12.

Figure 7:
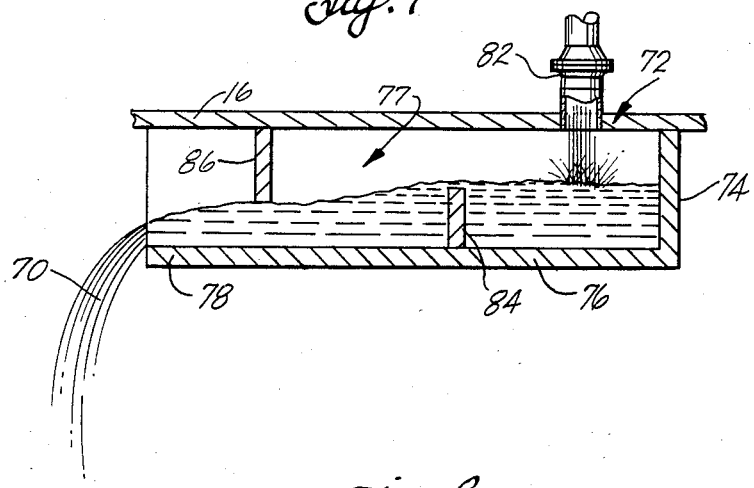
FIG. 7 is a side section view of a sluice for applying pickling solution to the wire.
Figure 8:
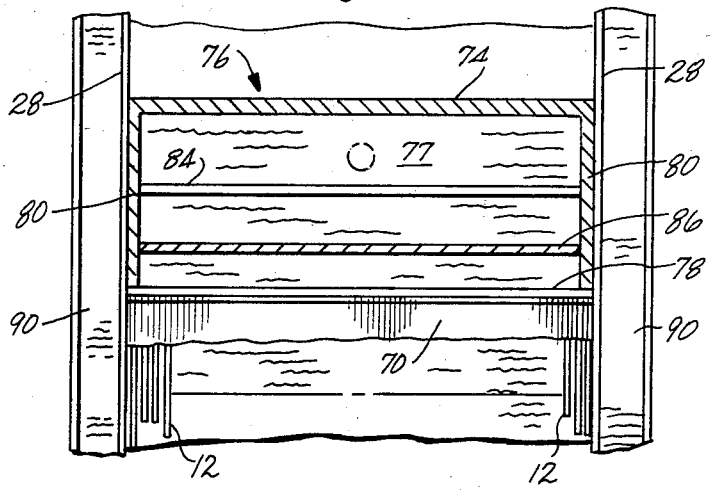
FIG. 8 is a partial top plan view of a sluice for cascading pickling solution.

As stated above, the device 10 is adapted to pickle, in a continuous fashion, strands of wire 12 as the strands pass through the device 10. To provide for such pickling, the device 10 includes means for applying a pickling solution to the wire 12 as it passes through the device passageway 52. Such means may include a spray or bath, or, as preferred and shown in the drawings, means for defining a pickling cascade 70 which flows over and around the wire. The aforementioned cascading means includes a pickling sluice 72 suspended from the underside of the top 16 as shown in FIGS. 4, 7 and 8. As shown pickling sluice 72 has a rear wall 74 attached to the top 16 and extending laterally thereacross to lie, when the top 16 is positioned over the tank 14, between the the tank sides 24. From the rear wall 74 a shelf 76 projects longitudinally to terminate at a forward edge defining a spillway 78. Sidewalls 80 are interconnected between the top 16, shelf 76 and rear wall 74 to define a fluid basin 77 for the pickling sluice 72.

To introduce the pickling solution, which may be water with 22 to 23 percent hydrochloric acid, into the pickling sluice 72 a solution inlet 82 is provided at the top 16. One or more pumps, as described below, continuously supply the solution to the solution inlet 82 and to the pickling sluice 72. To cause the solution to form the desired pickling cascade 70, the pickling sluice 72 has means for conditioning the flow of fluid in the pickling sluice 72. The flow conditioning means includes a dam 84 which extends between the sidewalls 80 and projects upwardly from the shelf 76 to terminate short of the top 16. The dam 84 is spaced from the rear wall 74 so as to locate the solution inlet 82 therebetween. Accordingly, by virtue of the dam 84, the solution entering the pickling sluice 76 fills the basin 77 between the side walls 80 as fluid flow is slowed and distributed. The solution passes over the dam 84 and beneath a flow-controlling gate 86 which projects downwardly from the top 16 and spans the sidewalls 80 at a location intermediate the dam 84 and spillway 78. The solution, the flow of which has been slowed and distributed, thereafter passes over the spillway 78, continuously creating the pickling cascade 70 which falls downwardly over the wire 12 as a continuous sheet of solution. Passing over the wire, the solution flows through the tray 58 and is collected in the sump and well 20 of the pickling portion 46. In a manner described below, the collected solution is thereafter recirculated to the solution inlet 82 for the continuous formation of the pickling cascade 70 for the pickling of the wire 12.

In the pickling of the wire 12 as described above, noxious and corrosive fumes tend to be produced due to the presence of the hydrochloric acid. If permitted to escape from the device 10, these fumes would present a health hazard and would tend to corrode surrounding surfaces as the acid fumes condense thereon.

While the top 16 and tank 14 define generally upper and lower barriers against the escape of fumes eminating from within the device 10 from the pickling of the wire, means are required to prevent the fumes from escaping from the inlet and outlet openings 54 and 56 and, if the top 16 is removable from between the top 16 and tank sides 24. If the top 16 is permanently affixed to the tank 14, suitable seal or welding or the like may be provided between the tank sides 24 and top 16 to prevent fumes from escaping. However, a permanently attached and sealed top 16 prevents a problem of initially positioning the wire 12 through the device 10 for the continuous pickling of long strands. Accordingly, a removable top 16 is preferred. Removability of the top 16, therefore, presents a need for sealing the top 16 to the tank 14 along its sides 24.

To provide a means for sealing the top 16 along its sides to the tank 14, liquid seal means are provided. The liquid seal means, referring to FIGS. 1 and 5 include downwardly depending side skirts 88 affixed to and extending along the side edges of the top 16. These skirts 88 are fashioned from acid corrosion resistant materials.

To cooperate with the skirts 88 to define the liquid seal means, liquid containing troughs 90 are disposed along the outer sides of each of the tank sides 24. Each trough 90 is positioned to receive and submerge a corresponding top skirt 88. The troughs 90 extend along the entire length of the tank 14 from the inlet end 34 to the outlet end 36. As best shown in FIGS. 1 and 5, each trough 90 is rectangular in cross section and is preferably constructed from acid corrosion resistant materials like those used for the tank 14 and top 16. Refering to FIGS. 3 through 5, each such trough 90 slopes downwardly from the wire inlet end 34 to the outlet end 36 for purposes which will hereinafter become evident. At the wire inlet end 34, the troughs 90 are closed, whereas at the wire outlet end 36 each such trough 90 includes a liquid flow restrictive aperture 92 adapted to discharage liquid from each trough 92 into the sump at the rinse portion 48 at a controlled rate. The pickling sluice 72 does not discharge pickling solution into the troughs 90.

When the top 16 is positioned over the tank 14, each skirt 88 is received into a corresponding trough 90. Preferably, the top 16 is suspended over the tank 14 such that the skirts 88 do not bottom in the troughs 90. Continually filling the troughs 54 at the inlet end 34 with a liquid, such as water, at a controlled rate in cooperation with the apertures 92, fills the troughs 90 and submerges the skirts 52 to create a liquid seal between the tank 14 and top 16 and prevent harmful and corrosive fumes from escaping at the sides of the device 10. By virtue of the slope of the troughs 90, providing a constant supply of the liquid at the inlet end 34 for each trough 90 at a controlled rate, results in the liquid filling the troughs 90 and flowing toward the outlet end 36 for ultimate discharge from each trough 90 via its aperture 92. The flow restriction presented by the aperture 92 maintains each trough 90 full while at the same time permitting the liquid to circulate through the troughs 90.

As stated above, the preferable position of the top 16 is to be suspended over the tank 14 such that the skirts 52, while being submerged, are spaced above the bottom of the troughs 90. The space beneath each skirt 52 within each trough 90 defines a way 94 (FIG. 5) through which the strands of wire 12 may be positioned in the device 10 without lifting the top 16. Viewing FIG. 2, to position or "load" a strand of wire (shown as 12' in the drawing) to be pickled into the device, a segment of the wire 12' is submerged into the trough 90 and is passed through the way 94 at one corner of the device 10. Thereafter the remainder of the wire 12' lying alongside the device 10 is similarly submerged in the trough 90 and passed through the way 94 and into the passageway 52. Once the wire 12' is in the passageway 52, it can be appropriately positioned in any desired track 66.

The above described method of positioning a new strand of wire or re-positioning a broken strand in the device 10 is advantageous in that the top 16 does not have to be removed nor is the liquid seal means at the sides of the device 10 disturbed. Accordingly, fumes from within the device 10 are not released when wire strand loading is desired. Furthermore, it is believed that loading of the wire 12 into the device 10 is simplified since the skirt 88 and trough 90 tend to hold the wire 12' as it is progressively passed through the way 94. As an added advantage, close tolerances are not required to seal the top and tank, thereby contributing to inexpensive construction thereof.

As can be appreciated, in addition to sealing the longitudinal sides of the device 10, i.e., between the top 16 and tank 14, means are also required to prevent fumes from escaping at the inlet and outlet openings 34 and 36. In sealing the inlet 34 and outlet 36 openings, the chosen means should be effective to prevent the escape of fumes, to permit the wire to pass freely therethrough for pickling and preferably should be inexpensive and reliable.

To define such seal means for the inlet and outlet openings 34 and 36 the device 10 includes means for continuously cascading a liquid such as water across the inlet and outlet to define, in essence, barriers against the escape of fumes from the pickling portion. These barriers, at the same time, permit the wire to pass continuously through the device 10. While the cascading means at each of the inlets and outlets 34 and 36 may be embodied as one liquid cascade, a series of liquid cascades **96*a–c* and 96*d–f* arranged serially at the inlet and outlet 34 and 36, respectively as shown in FIG. 4**, are preferred to provide a series of barriers against the escape of fumes.

To create each of the cascades **96*a–c* and 96*d–f*, a water sluice 98 suspended from the underside of the top 16 is provided. Since the water sluices are substantially identical, only one will be described in detail. Further, in that the water sluices 98 are similar to the pickling sluice 72, portions thereof corresponding to those described above in reference to the pickling sluice 72 will carry a prime (') designation. While in the pickling of wire 12** it has been found that water can advantageously be used to define the cascades, any suitable liquid solution or heavier-than-air fluid could be used.

Figure 6:
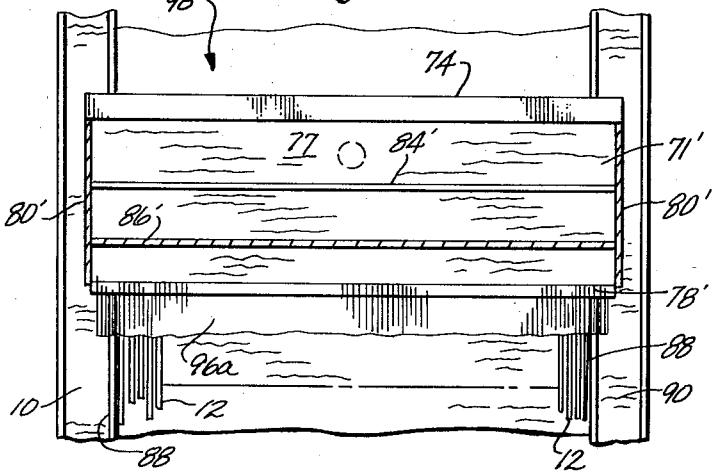
FIG. 6 is a partial top plan view of the device of FIG. 1 illustrating a sluice for defining the cascades.

Turning to FIGS. 4, 5 and 6, the water sluice 98 includes a rear wall 74' affixed and sealed to the top 16, the rear wall traversing the passageway 52 to project over each of the troughs 90. A shelf 76' extends from the rear wall 74' toward the inlet opening 54. At the outlet opening 56 the water sluice shelves extend in an opposite direction toward the outlet opening 56 as shown in the drawings. Side walls 80' are interconnected between the shelf 76', rear wall 74' and top 16 to form a channel or basin 77' to receive water for the formation of a fluid cascade **96*a*. To supply water to the water sluice 98, water inlets 102** are provided, each dedicated to a particular sluice.

Water provided to the water inlets as represented by water inlet 102, enters the basin 77'. To distribute and slow the water, each water sluice 98 includes a dam 84' which projects upwardly from each shelf 76' toward, but spaced from, the top 16 and extends between the sidewalls 80'. Accordingly, water entering the basin 77' fills a portion of the basin 77' and thereafter spills over the dam 84'. From the dam 84' the water flows under a flow controlling gate 86' depending from the top 16 and spanning the sidewalls 80'. The space between the gate 86' and shelf 76' controlls the flow rate. After passing the gate 86' the liquid flow has been suitably slowed, distributed and controlled and flows over the spillway 78' so as to define the liquid cascade **96*a* which flows across the passageway 52 and, more particularly, the inlet opening 54 and into each of the troughs 90**.

Each water cascade **96*a–f* flows over the wire strands 12 and onto the tray supporting and guiding the wire. Flowing through the various apertures in the tray 58 the water is collected in either the quench portion sump 38*a* or the rinse portion sump 38*c*, as the case may be. To prevent fumes from escaping by passing beneath the trays to either the inlet or outlet openings 54 or 56, each of the sumps has a water level 104 at the lower support member 60 of each tray 58. The partitions 40 and 42 and end walls 30 and 32** are sized to accomodate such liquid levels.

As can be appreciated, each liquid cascase **96*a–f* defines a barrier against the escape of fumes from the pickling portion of the device 10. At the same time, each of the liquid cascades 96*a–f* freely passes the wire 12 for pickling thereof. At the rinse portion 48 each cascade 96*d–f* in addition to defining a barrier against the escape of fumes, advantageously rinses the wire 12** passing therethrough to remove the pickling solution from the wires' surface.

Each liquid cascade **96*a–f* produced by the water sluices 98*a–f* extends downwardly from the spillway to the tray and between the skirts 88 such that the barriers against the escape of fumes completely spans the passageway 52. Each liquid sluice sidewall 80' and the rear wall 74' in conjuction with the liquid cascade completes the barrier against the escape of fumes. By virtue of the span of the liquid cascades, each such cascade 96***a–f* also provides water to each of the troughs 90 to maintain them filled with water and the skirts 88 submerged.

To prevent the liquid sumps 38*a–c* from overflowing and the water levels 104 from dropping and providing an escape route for the fumes, liquid level control means are provided. The liquid level control means are preferably embodied, as shown in FIGS. 1 and 5, as at least one standpipe 106 which passes through the tank sides 24 into the aforementioned liquid sumps 38*a–c*. Each standpipe 106 includes an elbow which locates the open end of the standpipe defining a suction inlet 108 at the desired liquid level 104. Accordingly, as liquid enters a sump, it flows into the standpipe 106 to maintain the desired liquid levels in the sumps.

While not required, the solution sump 38*b* may also include a standpipe, however, since the level of solution in this sump may vary, standpipes are not necessary. Furthermore, it is to be understood that other suitable level control means could be employed.

Figure 9:
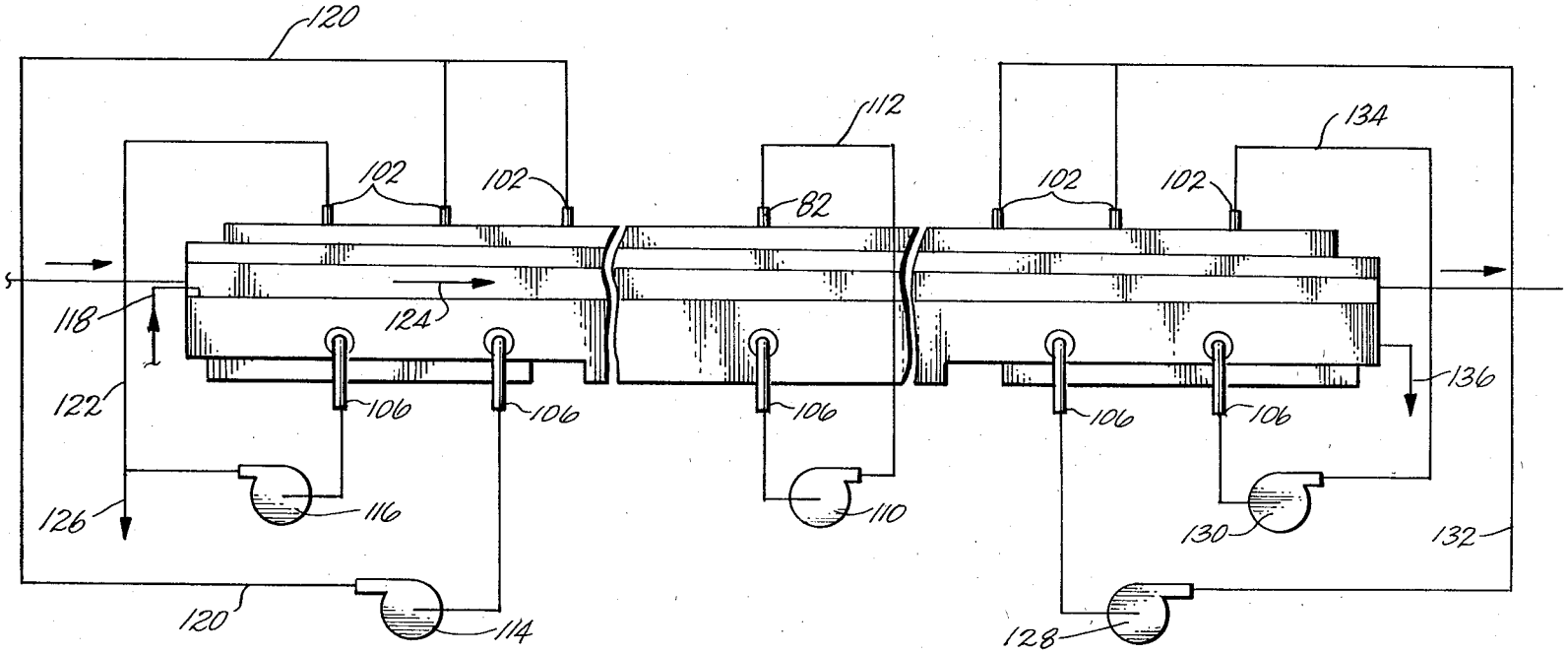
FIG. 9 is a side schematic view of the device of FIG. 1 illustrating the process for fumeless strand pickling.

Turning to FIGS. 1 and 9, the method for fumeless pickling of the wire 12 is shown. The method includes passing the product, i.e., wire, through the device 10. As stated above, the method may include passing the product through the device on a continuous or batch basis. To pickle the wire 12, the pickling solution is circulated with a solution pump 110.

The pump 110 withdraws the solution from the pickling portion sump via standpipe 106 and delivers it to inlet 82. An exemplary capacity and delivery rate for the pump 110 through line 112, wherein spillway 78 is approximately five feet across, is 120 gallons per minute. The circulation by the pump 110 is on a continuous basis in that little solution is lost through evaporation (such evaporation condenses and falls back into the sump due to the cooling effect of the circulating liquid in the troughs 90). After a time, however, it may be necessary to replace the solution due to contamination and degradation.

To provide water at the quench portion 44 for generation of the cascade 96*a–c* and to the troughs 90, a pair of liquid pumps 114 and 116 are provided. As shown in FIG. 9, to provide a constant supply of clean water, line 118 is provided. For the exemplary device 10, fifty feet long and about six feet wide, it has been found that supplying about 15 gallons per minute to the quench portion sump provides for the interchange of water in the device sufficient to keep it clean for an acceptable period of time.

Liquid pump 114 circulates water from the quench portion sump to header 120 which simultaneously supplies water to inlets 102 for sluices 98 which define cascades 96*b* and *c*. Liquid pump 116 provides water to the inlet 102 for the creation of cascade 96*a* via line 122.

Since these cascades 96*a–c* also supply water, which is eventually discharged into the rinse portion sump, to the troughs 90, the pumps 114 and 116 must deliver sufficient water for this purpose. It has been found that a combined flow rate for both troughs 90 of five (5) gallons per minute is sufficient as shown by arrow 124. Additionally, to provide for the interchange of water at the quench portion sump, it necessary follows that the balance of the flow in line 118 (i.e., 10 gallons per minute) must be removed from the sump to prevent overflow. Accordingly, a branch 126 is provided on line 122 at pump 116 discharge to direct 10 gallons per minute away from the device 10 to, for example, the plant cooling tower.

Given the foregoing, it has been determined that the output of pump 114 should be, for the illustrative device 10, 123.4 gallons per minute; 61.7 gallons per minute for cascades 96*b* and *c*, whereas the discharge of pump 116 should be 71.7 gallons per minute, 61.7 gallons per minute of which define cascade 96*a*. Approximately 1.7 gallons per minute for each cascade 96*a–c* is delivered to the troughs 90 providing the aforesaid 5 gallons per minute.

At the rinse portion 48, again, two liquid pumps 128 and 130 are provided. Pump 128 via header 132 delivers 120 gallons per minute, which is split into two 60 gallon per minute flows to inlets 102 serving cascades 96*d* and *e*. Pump 130 delivers 60 gallons per minute through line 134 to inlet 102 for creation of cascade 96*f*. Five gallons per minute is continuously drawn off by line 136 from the rinse portion sump thereby maintaining a constant levels in the sump.

Of course it can be appreciated that the foregoing description is by way of illustration only. The flows and arrangement of pumps and the like may change as desired or as required by the size of the device 10 and its cascades.

As is apparent, the device and methods according to the present invention have significant advantages. One advantage is that it is effective in containing fumes. A further advantage is that it is relatively inexpensive to construct and operate. Extensive and costly ventilation systems are not required since no fumes are released. Yet another advantage is that the cascades, while forming fume barriers, permit pickling to proceed continuously which is important where long or strand materials, i.e., wire, are involved.

The foregoing device and method are subject to many modifications without departing from the spirit and scope of the following claims.

What is claimed is:

1. A device for treating a product as it passes therethrough comprising:

a tank having an inlet opening to admit the product to be treated and an outlet opening for removal of the treated product;

a pair of fluid filled troughs each extending along a side of the tank;

a top covering the tank leaving only the inlet and outlet openings open, the top further including side skirts each of which is submerged in a trough when the top is positioned adjacent over the tank to seal the device along its sides against the escape of fumes;

means for treating the product between the inlet and outlet openings; and means for continuously cascading a fluid across the inlet and outlet openings between the skirts to supply fluid to each of the troughs to define barriers against the escape of fumes from the treating means.

2. The device of claim 1 wherein the troughs are sloped to cause the fluid to flow from one end of the device to the other, the troughs at the other end discharging fluid into the tank to prevent overflowing of the troughs.

3. The device of claim 2 wherein the discharge of each trough is adapted to control fluid flow to maintain the trough filled with fluid.

4. A method for treating a product comprising:

passing the product through a tank having an inlet opening to admit the product, an outlet opening for removal of the treated product and a pair of fluid filled troughs each extending along a side of the tank;

providing a top covering the tank leaving only the inlet and outlet openings open, the top having side skirts each of which is submerged in a trough when the top is positioned to close the tank to seal the device along its sides;

treating the product within the device between the inlet and outlet openings; and continuously cascading a fluid across the inlet and outlet openings between the skirts to supply fluid to each of the troughs and to define barriers against the escape of fumes from the treating of the product.

5. A device for treating a wire, cable or strand product drawn therethrough comprising:

a tank having along each side a fluid filled trough having a bottom;

a top to cover the tank leaving an inlet opening to receive the product and an outlet opening to remove the treated product and defining a passageway through the device, the top including side skirts each of which is submerged in the trough, at least one of the skirts being spaced from the trough bottom to define a submerged way for loading the strand product into the passageway for treatment thereof;

means for treating the product within the tank between the inlet and outlet openings; and means for continuously cascading a fluid across the inlet and outlet openings between the skirts to supply fluid to the troughs and to define barriers against the escape of fumes from the treating means.

* * * * *